US011262670B2

(12) United States Patent
Mochizuki et al.

(10) Patent No.: US 11,262,670 B2
(45) Date of Patent: Mar. 1, 2022

(54) ELECTROPHOTOGRAPHIC BLADE, PROCESS CARTRIDGE, AND ELECTROPHOTOGRAPHIC IMAGE FORMING APPARATUS

(71) Applicant: CANON KABUSHIKI KAISHA, Tokyo (JP)

(72) Inventors: Kenichi Mochizuki, Shizuoka (JP); Ryosuke Takayama, Shizuoka (JP); Takahiro Miyazawa, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/221,663

(22) Filed: Apr. 2, 2021

(65) Prior Publication Data

US 2021/0318637 A1 Oct. 14, 2021

(30) Foreign Application Priority Data

Apr. 8, 2020 (JP) ..... JP2020-069810
Feb. 24, 2021 (JP) ..... JP2021-027566

(51) Int. Cl.
*G03G 15/08* (2006.01)
*G03G 21/00* (2006.01)

(52) U.S. Cl.
CPC ..... *G03G 15/0812* (2013.01); *G03G 15/0818* (2013.01); *G03G 21/0017* (2013.01)

(58) Field of Classification Search
CPC ..... G03G 15/0812; G03G 21/0017
See application file for complete search history.

(56) References Cited

U.S. PATENT DOCUMENTS 8,965,264 B2 * 2/2015 Nakane ..... G03G 21/0017 399/350
2003/0081971 A1 * 5/2003 Nakayama ..... G03G 21/0011 399/350
2009/0311017 A1 * 12/2009 Oh ..... G03G 21/0017 399/350

FOREIGN PATENT DOCUMENTS

JP H08062974 A 3/1996
JP 2006145635 A * 6/2006
JP 2008090160 A 4/2008
JP 2008096507 A 4/2008
JP 2008276147 A 11/2008

* cited by examiner

*Primary Examiner* — Walter L Lindsay, Jr.
*Assistant Examiner* — Jessica L Eley
(74) *Attorney, Agent, or Firm* — Canon U.S.A., Inc., IP Division

(57) ABSTRACT

An electrophotographic blade to be brought into contact with a contact member, comprises a plate spring, and a resin layer that covers at least a part of a surface of the plate spring to form a contact region that comes into contact with a contact member. In the state where one of ends of the plate spring is fixed, a length (L) from the fixed end to the another end is 5 mm to 20 mm, and a force needed to displace the another end by 1 mm is 5 N/m to 100 N/m. The resin layer satisfies the requirements: (1) the thickness of the resin layer is 0.05 mm to 2.00 mm, (2) the tan δ value of the resin layer in the range of 5° C. to 40° C. is 0.05 to 0.70, and (3) the elastic modulus of the resin layer is 1.0 to 60.0 MPa.

8 Claims, 10 Drawing Sheets

ELECTROPHOTOGRAPHIC BLADE, PROCESS CARTRIDGE, AND ELECTROPHOTOGRAPHIC IMAGE FORMING APPARATUS

The present disclosure relates to an electrophotographic blade, a process cartridge, and an electrophotographic image forming apparatus.

BACKGROUND

In the electrophotographic image forming process, an electrophotographic blade is used for regulating a layer thickness of a developer (hereinafter, also referred to as "toner") into a thin layer, the developer being carried by a developer carrying member and conveyed to an image bearing member. The electrophotographic blade is brought into contact with the developer carrying member, and the toner is caused to pass through the space formed in the contact region to regulate the toner layer thickness.

Such electrophotographic blades currently used include a resin layer pressure welded to the developer carrying member, and a plate spring for pressure welding the blade to the developer carrying member at a predetermined pressure welding force. The electrophotographic blade having such a configuration is easily pressure welded with a uniform pressure welding force across the entire developer carrying member. Japanese Patent Application Laid-Open No. 2008-90160 discloses an electrophotographic blade including a plate spring and a resin layer, wherein the resin layer includes a thermoplastic polyester elastomer. Recently, a high-speed, highly durable electrophotographic apparatus providing high quality images are required. In middle or higher speed printers, vibration inside the electrophotographic image forming apparatus and vibration of the developer carrying member are increased. These vibrations may cause vibration of the contact region between the developer carrying member and the electrophotographic blade to generate an unstable contact state in some cases. Such an unstable contact region may result in an uneven layer thickness of the developer in the developer carrying member, generating electrophotographic images having uneven density in the form of horizontal streaks (hereinafter, also referred to as "banding images") in some cases.

SUMMARY

At least one aspect of the present disclosure is directed to providing an electrophotographic blade which contributes providing high-quality electrophotographic images. At least one of aspects of the present disclosure is directed to providing a process cartridge capable of forming high-quality electrophotographic images. Further, at least one aspect of the present disclosure is directed to providing an electrophotographic image forming apparatus which can provide high-quality electrophotographic images.

According to one aspect of the present disclosure, there is provided an electrophotographic blade comprising: a plate spring, and a resin layer that covers at least a part of a surface of the plate spring to form a contact region, wherein one end portion of the plate spring is fixed so that a length (L) from a fixed end to another end of the plate spring is 5 mm or more and 20 mm or less, such that a force needed to displace the another end by 1 mm is 5 N/m or more and 100 N/m or less, and wherein the resin layer satisfies the following requirements (1) to (3).

(1) The thickness of the resin layer is 0.05 mm or more and 2.00 mm or less.

(2) The tan δ value of the resin layer in the range of 5° C. or more and 40° C. or less is 0.05 or more and 0.70 or less.

(3) The elastic modulus of the resin layer is 1.0 MPa or more and 60.0 MPa or less.

According to another aspect of the present disclosure, there is provided an electrophotographic image forming apparatus including a developer carrying member and the electrophotographic blade that is in contact with the developer carrying member.

Furthermore, according to still another aspect of the present disclosure, there is provided a process cartridge detachably attachable on the body of the electrophotographic image forming apparatus, the process cartridge including a developer carrying member and the electrophotographic blade that is in contact with the developer carrying member.

Further features of the present disclosure will become apparent from the following description of exemplary embodiments with reference to the attached drawings.

DRAWINGS

EMBODIMENTS

Preferred embodiments of the present disclosure will now be described in detail in accordance with the accompanying drawings.

At least one aspect of the present disclosure is an electrophotographic blade that is to be brought into contact with a contact member. The electrophotographic blade includes a plate spring, and a resin layer that covers at least a part of a surface of the plate spring to form a contact region that comes into contact with the contact member such as a developer carrying member. When one end portion of the plate spring is fixed so that a length (L) from a fixed end to another end is 5 mm or more 20 mm or less, a force needed to displace the another end by 1 mm is 5 N/m or more and 100 N/m or less. Furthermore, the resin layer satisfies the following requirements.

(1) The thickness of the resin layer is 0.05 mm or more and 2.00 mm or less.

(2) The tan δ value of the resin layer in the range of 5° C. or more and 40° C. or less is 0.05 or more and 0.70 or less.

(3) The elastic modulus of the resin layer is 1.0 MPa or more and 60.0 MPa or less.

The case where the present disclosure is used as an electrophotographic blade will now be described in detail. Embodiments for implementing the disclosure illustrate the present disclosure, but these embodiments should not be construed as limitations to the present disclosure.

[Configuration of Blade with Regulated Amount of Developer]

Figure 1:
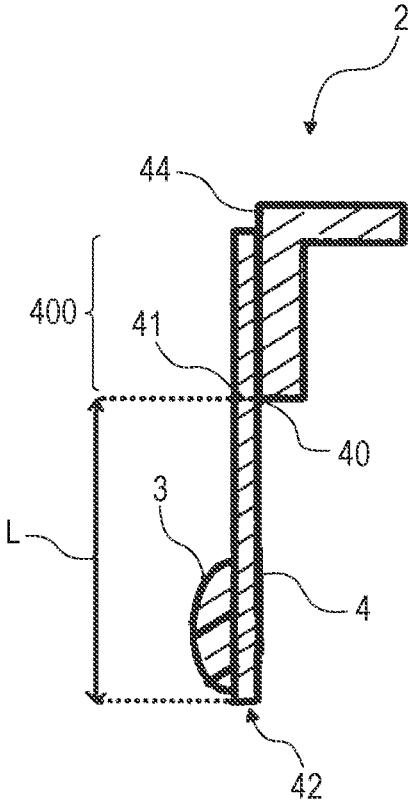
FIG. 1 is a diagram illustrating the electrophotographic blade according to one aspect of the present disclosure.

FIG. 1 shows a schematic cross-sectional view of one example of the electrophotographic blade according to one aspect of the present disclosure. The electrophotographic blade 2 includes at least a plate spring 4 and a resin layer 3. The resin layer 3 forms a contact region that is to be brought into contact with a contact member 1 such as a developer carrying member. The plate spring 4 is fixed to the support member 44 at one end portion, i.e., fixed portion 400, and when a point in the fixed portion 400 closest to the other end 42 is defined as the fixed end 41, the length from the fixed end 41 to the other end 42 as a free end is defined as the length "L". The thickness of the resin layer 3 refers to the largest thickness of the resin layer 3 from the surface thereof facing the plate spring 4.

Figure 2:
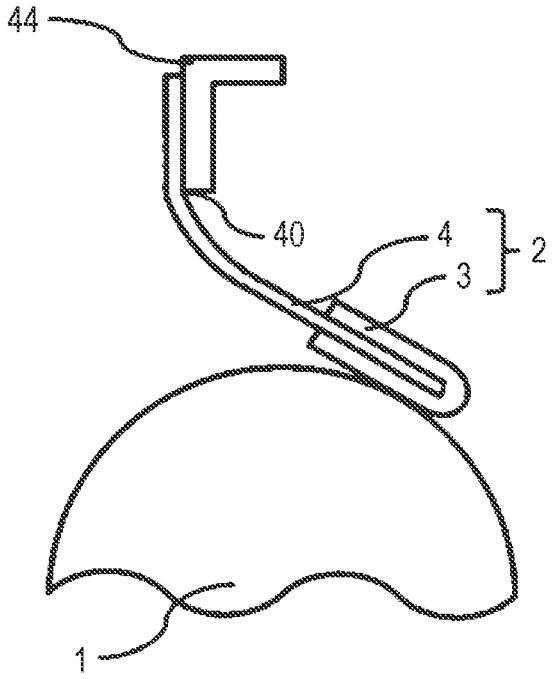
FIG. 2 is a diagram showing one example of the state where the blade shown in FIG. 1 is in contact with the surface of the contact member.

As shown in FIG. 2, in the electrophotographic blade 2, the plate spring 4 is fixed to a support member 44. A fixed point 40 functions as a fulcrum to bring the other end 42 into contact with the surface of the contact member 1.

[Resin Layer]

The resin layer 3 has:

(1) a thickness of 0.05 mm or more and 2.00 mm or less, (2) a tan δ value of 0.05 or more and 0.70 or less at a temperature in the range of 5 to 40° C., and (3) an elastic modulus of 1.0 MPa or more and 60.0 MPa or less at a temperature in the range of 5 to 40° C.

The present inventors have found that even if the developer carrying member vibrates, an uneven thickness of the toner layer on the developer carrying member can be prevented by optimizing the thickness of the resin layer and the elastic modulus and tan δ of the resin layer at the temperature for actual use. What is effective in suppressing an uneven thickness of the toner layer is, for example, high compatibility between a reduction in initial amplitude of vibration attributed to the developing roller and early decay of the vibration.

<tan δ>

Adjustment of the tan δ of the resin layer is effective to the early decay of the vibration transmitted to the electrophotographic blade. The tan δ of a high-molecular compound as a viscoelastic substance indicates a value obtained by dividing the loss elastic modulus E" by the storage elastic modulus E', and is a parameter representing an ability of the viscoelastic substance to lose energy as heat when it deforms.

The lower limit of tan δ of the elastic layer is 0.05 or more, preferably 0.10 or more at a temperature in the range of 5° C. or more and 40° C. or less, which is an environment for actual use. Thereby, the vibration attributed to the developing member can be efficiently lost as thermal energy as a result of deformation of the elastic layer. The upper limit of tan δ is 0.70 or less, preferably 0.50 or less, particularly preferably 0.30 or less to prevent an increase in time until the deformed resin restores its original shape, and thus an uneven thickness of the toner layer.

<Storage Elastic Modulus E' (Elastic Modulus)>

Use of a resin layer having a small storage elastic modulus E' (hereinafter, also simply referred to as "elastic modulus") is effective in reducing the initial amplitude. Specifically, the initial amplitude of the vibration transmitted to the developing blade can be reduced by controlling the elastic modulus to be 60.0 MPa or less, preferably 50.0 MPa or less, particularly 15.0 MPa or less at a temperature in the range of 5° C. to 40° C., which is an environment for actual use. The lower limit of the elastic modulus is 1.0 MPa or more, preferably 2.0 MPa or more, particularly 5.0 MPa or more to prevent generation of an uneven contact pressure of the electrophotographic blade to the developer carrying member.

<Thickness of Resin Layer>

The thickness of the resin layer is 0.05 mm or more, more preferably 0.10 mm or more. If the resin layer has a thickness of 0.05 mm or more, the amount of the resin which can absorb vibration can be sufficiently ensured, and thus the vibration can be efficiently converted into thermal energy. As a result, the early decay of the vibration attributed to the developing member can be provided.

Meanwhile, the upper limit of the thickness of the resin layer is 2.00 mm or less, more preferably 1.00 mm or less. If the thickness of the resin layer is controlled to be 2.00 mm or less, the electrophotographic blade can have a more uniform force of regulating the toner layer on the surface of the developing member to provide a uniform thickness of the toner layer. As a result, unevenness of images attributed to an uneven thickness of the toner layer can be prevented.

In an electrophotographic blade which satisfies all of these three requirements, the resin layer can quickly absorb the vibration of the developer carrying member to prevent generation of banding in electrophotographic images. Moreover, the electrophotographic blade can provide a more uniform thickness of the toner layer on the surface of the developing roller to prevent generation of an uneven density and stripes in electrophotographic images.

<Materials for Forming Resin Layer>

The resin layer can be formed of any resin. Preferred is use of thermally cured urethane elastomers. While a resin having a large tan δ converts vibration into thermal energy, an increase in resin temperature results in a reduction in tan δ. For this reason, the converted heat should be quickly dissipated. The thermally cured urethane elastomers, which have high thermal conductivity, can efficiently dissipate the heat converted from vibration energy.

The thermally cured urethane elastomer is prepared from urethane raw materials containing at least polyisocyanate and polyol. Preferred thermally cured urethane elastomers are prepared by reacting a polyol containing at least one of polyether polyol or polyester polyol with 4,4'-diphenylmethane diisocyanate.

These raw materials will now be described in detail.

(Polyisocyanate)

Examples of polyisocyanates include: 4,4'-diphenylmethane diisocyanate (MDI), 2,4-tolylene diisocyanate (2,4-TDI), 2,6-tolylene diisocyanate (2,6-TDI), xylene diisocyanate (XDI), 1,5-naphthylene diisocyanate (1,5-NDI), p-phenylene diisocyanate (PPDI), hexamethylene diisocyanate (HDI), isophorone diisocyanate (IPDI), 4,4'-dicyclohexylmethane diisocyanate (hydrogenated MDI), tetramethylxylene diisocyanate (TMXDI), carbodiimide-modified MDI, and polymethylenephenyl polyisocyanate (PAPI). Among these, preferred is MDI because it provides a polyurethane elastomer having high mechanical properties.

(Polyol)

Examples of polyol include: polyester polyols such as polyethylene adipate polyol, polybutylene adipate polyol, polyhexylene adipate polyol, (polyethylene/polypropylene) adipate polyol, (polyethylene/polybutylene) adipate polyol, and (polyethylene/polyneopentylene) adipate polyol; polycaprolactone-based polyols prepared through ring-opening polymerization of caprolactone; polyether polyols such as polyethylene glycol, polypropylene glycol, and polytetramethylene ether glycol; and polycarbonate polyol. These can be used alone or in combination of two or more thereof. Further, acrylic polyol of which acrylate ester or methacrylate ester is polymerized with the above-mentioned polyol, or polyol of which plurality of hydroxyl groups are chemically incorporated into a silicone compound such as polydimethylsiloxane, can also be used.

The thermal conductivity of the thermally cured urethane elastomer is significantly affected by the type of polyol. Phonons, which are quantized lattice vibration, are responsible for thermal conduction in the resin not having free electrons. The thermal conductivity is increased by increasing the mean free path of the phonon. Scattering of phonons hardly occurs in crystalline portions of the resin because these portions have high harmonicity of lattice vibration. For this reason, selection of a polyol having high crystallinity is preferred to enhance the thermal conductivity.

Among these preferred are polyester polyols or polyether polyols having high crystallinity.

Among these, polyether polyols are preferred, and polytetramethylene ether glycol is more preferred. If the urethane elastomer has a large average molecular weight, hard portions (hard segments) formed of the polyisocyanate and soft portions (soft segments) formed of the polyol are likely to be localized, and the scattering of phonons occurs at the interface. This reduces the thermal conductivity. For this reason, the polyol has an average molecular weight of preferably 2000 or less, more preferably 380 or more and 1600 or less. In other words, the most preferred polyol is polytetramethylene glycol (PTMG) having an average molecular weight of 650 or more and 1000 or less.

Accordingly, the thermally cured urethane elastomer according to one aspect of the present disclosure preferably has a structure represented by the following formula (1) between two adjacent urethane bonds:

$$—[(CH_2)_nO]_m— \quad (1)$$

where n represents an integer of 2 or more, and m represents an integer of 1 or more. Here, n and m are numeric values needed to control an average molecular weight of the portions having the alkylene oxide structure represented by the formula (1) in the thermally cured urethane elastomer to be 380 to 1600.

In the thermally cured urethane elastomer, the proportion of the polyether polyol in the thermally cured urethane elastomer is preferably 50 wt % or more and 80 wt % or less. The necessary crystallinity can be obtained if the proportion of polyether polyol is 50 wt % or more, and the necessary elastic modulus can be obtained if the proportion is 80 wt % or less. In other words, the thermally cured urethane elastomer according to one aspect of the present disclosure preferably includes a polyol represented by the formula (2) in the hydrolysate of the thermally cured urethane elastomer, and the proportion of the polyol in the hydrolysate is 50 to 80 wt %:

$$HO—[(CH2)nO]m-H \quad (2)$$

where n represents an integer of 2 or more; and m represents an integer of 1 or more. Here, n and m are numeric values needed to control an average molecular weight of the portion having the alkylene oxide structure in formula (2) in the thermally cured urethane elastomer to be 380 to 1600.

In the present disclosure, the molecular weight of the polyether polyol indicates the value obtained by measurement of the average molecular weight of the hydrolysate described later in Examples.

(Chain Extender)

Any chain extender can be added to the urethane raw materials as needed as long as it has a molecular weight of 200 or less and can extend polyurethane elastomer chains. For example, glycol is used. Examples of such glycol include: ethylene glycol (EG), diethylene glycol (DEG), propylene glycol (PG), dipropylene glycol (DPG), 1,4-butanediol (1,4-BD), 1,6-hexanediol (1,6-HD), 1,4-cyclohexanediol, 1,4-cyclohexanedimethanol, xylylene glycol (terephthalyl alcohol), and triethylene glycol. Besides the glycols above, other polyhydric alcohols can also be used. Examples thereof include trimethylolpropane, glycerol, pentaerythritol, and sorbitol. These can be used alone or in combination of two or more thereof.

A small amount of the chain extender is preferred. The polyisocyanate is likely to be densely present around the chain extender, locally increasing the hardness. An increase in amount of the chain extender clearly leads to the presence of a large number of portions having different hardnesses, and scattering of phonons occurs at the interfaces. This reduces the thermal conductivity. Accordingly, to enhance the thermal conductivity, it is preferred that the chain extender be not used. However, to improve the productivity, an increase in curing rate is expected by adding an appropriate amount of the chain extender. Thus, a small amount thereof is preferably added. The amount to be added at this time is preferably 0.25 mmol/g or less, particularly preferably 0.0 mmol/g. In other words, in the thermally cured urethane elastomer according to one aspect of the present disclosure, the content of the alcohol having a molecular weight of 200 or less in the hydrolysate is 0.25 mmol/g or less, particularly preferably 0.0 mmol/g relative to the hydrolysate, i.e., the hydrolysate is preferably free from the alcohol having a molecular weight of 200 or less.

(Catalyst)

A catalyst usually used for curing a polyurethane elastomer may be added to the urethane raw materials. Examples thereof include tertiary amine catalysts. Specifically, examples thereof include: aminoalcohols such as dimethylethanolamine, N,N,N'-trimethylaminopropylethanolamine, and N,N-dimethylaminohexanol; trialkylamines such as triethylamine; tetraalkyldiamines such as N,N,N'N'-tetramethyl-1,3-butanediamine; triethylenediamine, piperazine compounds, and triazine compounds. Organic acid salts of alkali metals such as potassium acetate and potassium ocrylate can also be used. Furthermore, metal catalysts usually used in urethanization, such as dibutyltin dilaurate, can also be used. These can be used alone or in combination of two or more thereof.

Examples of other materials which may be added to the urethane raw materials include additives such as a pigment, a plasticizer, a waterproof agent, an antioxidant, an ultraviolet absorbing agent, and a light stabilizer. These additives may be compounded in the raw material composition as needed.

[Plate Spring]

The plate spring is a member which causes a contact pressure of the electrophotographic blade to the developer carrying member. In other words, the electrophotographic blade can be brought into contact with the developer carrying member at a more appropriate pressure by adjusting the rigidity of the plate spring. As a result, the thickness of the toner layer on the developer carrying member can be controlled in a better manner.

For this reason, when one end portion of the plate spring is fixed so that a length (L) from a fixed end to another end is 5 mm or more to 20 mm or less, a force needed to displace the another end by 1 mm is 5 N/m or more and 100 N/m or less. An electrophotographic blade having the plate spring having the force of 5 N/m or more gives a sufficient springiness to the electrophotographic blade. As a result of that, the electrophotographic blade can provide an appropriate contact pressure to the developer carrying member. The force is preferably 10 N/m or more. By controlling the force to be 100 N/m or less, application of excessive stress onto the toner on the developer carrying member can be prevented.

A material for the plate spring is preferably a metal or a resin.

The metals to be used can be surface-treated steel sheets subjected to chromate conversion coating and glossy resin coating, stainless steel (such as SUS304), phosphorus, bronze, and aluminum. Among these, more preferred is stainless steel because it enables contact at an appropriate contact pressure to the developer carrying member.

Examples of the resin include thermosetting resins such as acrylic resins, polyethylene resins, and polyester resins. If the plate spring needs electro-conductivity, an electro-conductivity imparting material may be added to the resin.

Examples of the electro-conductivity imparting material include ionically conductive agents or electron conductive materials such as carbon black.

Although not particularly limited, the plate spring preferably has a thickness of 0.05 mm or more and 0.15 mm or less. By controlling the thickness of the plate spring to be 0.05 mm or more and 0.15 mm or less, the plate spring can have appropriate springiness. Further, as shown in FIG. 1, the plate spring 4 is preferably be fixed to the support member 44 at the one end portion of the plate spring so that the length (L) from the fixed end 41 to the other end 42 is 5 mm or more and 20 mm or less. By fixing the plate spring 4 so as to have the length (L) of 5 mm or more, the electrophotographic blade can be stably be brought into contact with the developer carrying member. Further, by fixing the plate spring 4 so as to have the length (L) of 20 mm or less, the plate spring itself can be prevented from vibrating.

If the material for the plate spring is the thermoplastic resin, the plate spring can be formed by extrusion or injection molding, for example. Specifically, in molding by extrusion, the plate spring can be molded by thermally melting the thermoplastic resin and injecting the thermoplastic resin into a metal mold. In molding by injection molding, the plate spring can be molded by injecting the thermoplastic resin into a metal mold cavity, followed by cooling.

Figure 3A:
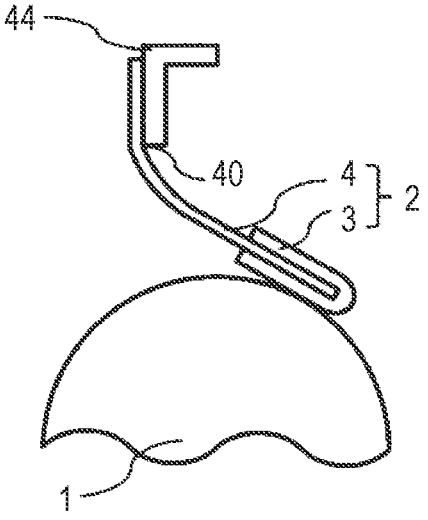
FIG. 3A is a diagram showing another example of the blade shown in FIG. 2.
Figure 3B:
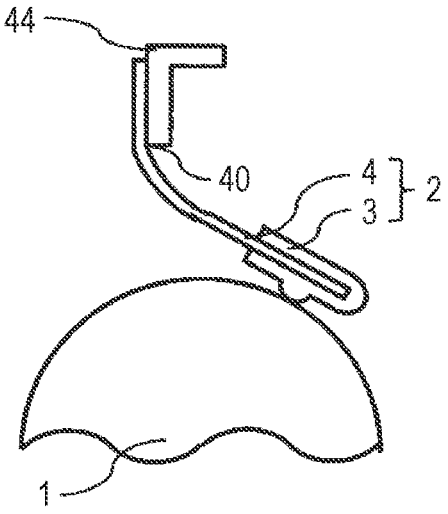
FIG. 3B is a diagram showing another example of the blade shown in FIG. 2.
Figure 3C:
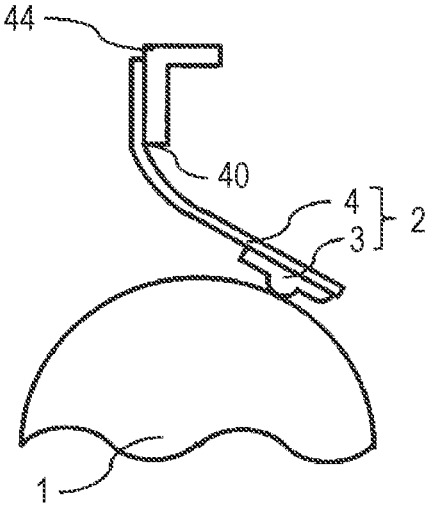
FIG. 3C is a diagram showing another example of the blade shown in FIG. 2.

Examples of the electrophotographic blade produced using the resin layer and the plate spring specifically include the embodiment shown in FIG. 2, and the embodiments shown in FIGS. 3A to 3C.

Figure 6:
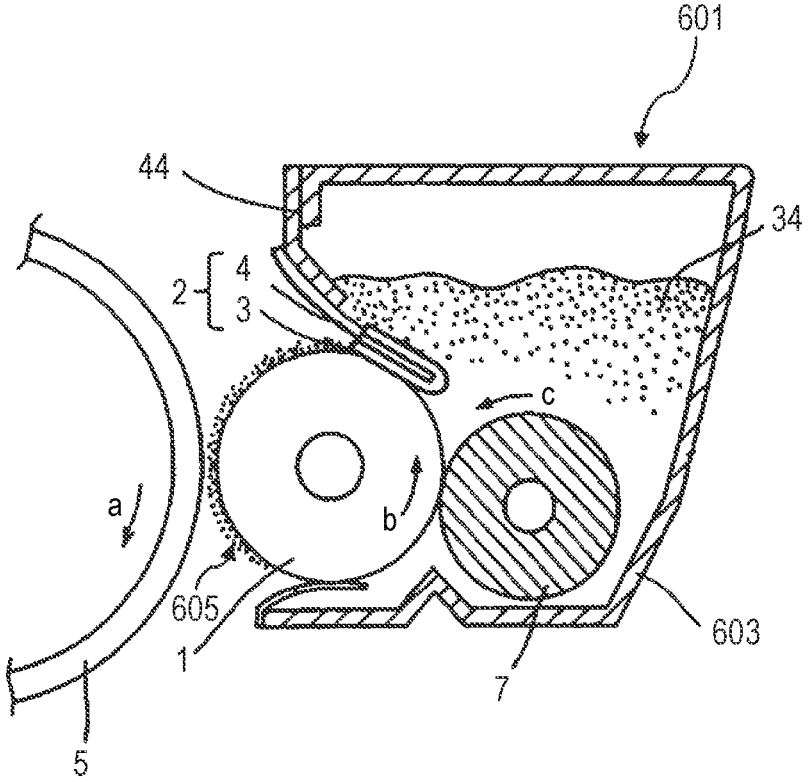
FIG. 6 is a diagram showing one example of the developing unit according to one aspect of the present disclosure.

In the electrophotographic blades 2 shown in FIGS. 2 and 3A to 3C, for example, the support member 44 is fixed to the frame 603 of the developing unit 601 as shown in FIG. 6. The fixed point 40 of the plate spring 4 to the support member 44 functions as a fulcrum to bring the plate spring 4 into contact with the surface of the developer carrying member 1 as the contact member. The blade regulates the thickness of the toner layer 605 formed on the surface of the developer carrying member 1. An electrostatic latent image formed on the electrophotographic photoreceptor 5 is developed with the toner layer 605 on the developer carrying member.

As shown in FIGS. 3A and 3B, the resin layer 3 forming the contact region brought in contact with the surface of the contact member 1 may be integrally formed as a coating that covers the surface facing the contact member 1 of the plate spring 4, the surface of the distal end, and the rear surface. Alternatively, as shown in FIGS. 2 and 3C, the resin layer 3 may be disposed only on the surface facing the contact member of the plate spring 4. The resin layer 3 can have any shape in the contact portion to the contact member 1. The shape may be a flat planar shape shown in FIG. 3A, a curved shape shown in FIG. 2, or a projected shape shown in FIGS. 3B and 3C. The shape may be a concave shape.

The resin layer 3 can be formed by a method such as casting, coating forming, or sheet bonding. Specifically, in molding by casting, a single plate spring 4 for the electrophotographic blade is placed into a metal mold. A mixture of a main agent and a curing agent is injected into the metal mold, and is reacted and cured by heating. The product is removed from the mold. Hereinafter, the mixture of the main agent and the curing agent before curing by heating is referred to as "mixture for forming the resin layer".

Figure 4:
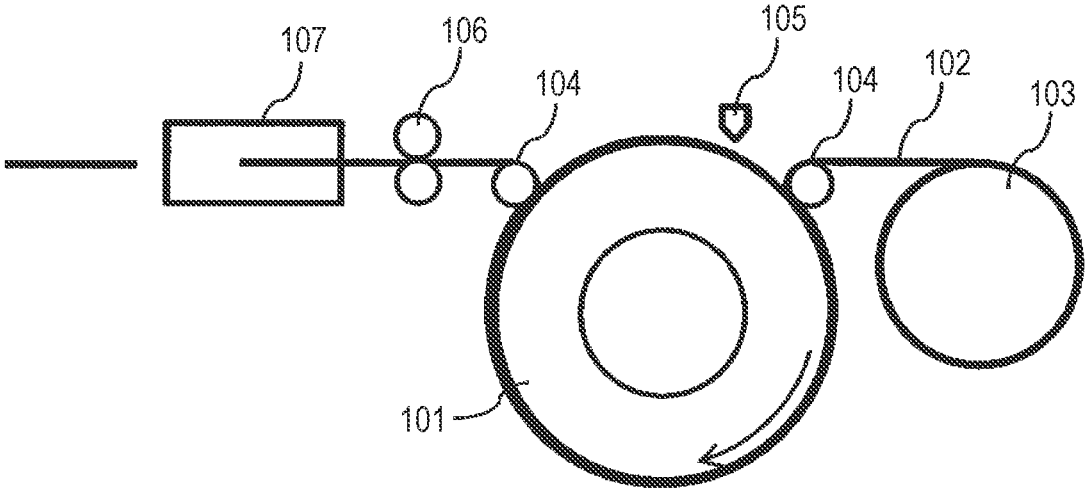
FIG. 4 is a diagram showing one example of an apparatus of producing the electrophotographic blade according to one aspect of the present disclosure.
Figure 5:
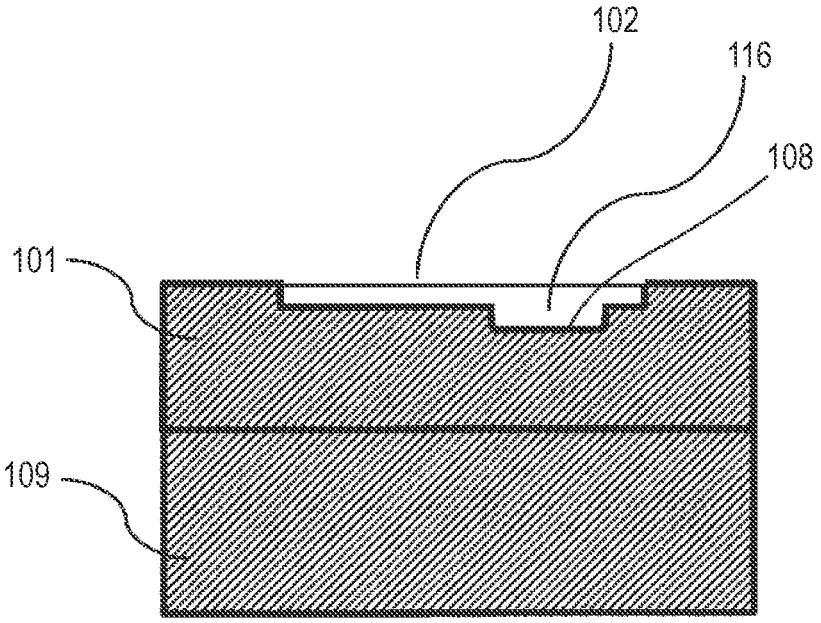
FIG. 5 is a cross-sectional schematic view of one example of a mold drum in the apparatus of producing the electrophotographic blade according to one aspect of the present disclosure.

As another example of casting, a production method performing continuous molding using a mold drum 101 and a strip plate 102 for the plate spring shown in FIGS. 4 and 5 can also be used, the mold drum 101 including a molding groove 108 continuously formed in the cross-section of the outer periphery and a heating mechanism 109 which heats the mold drum 101 to a predetermined temperature. In the basic production unit in this production method, the strip plate 102 for the plate spring is fed from the coiled strip plate 102 for the plate spring set in an uncoiler 103 through a pressurized contact region (guide roller) 104 to the mold drum 101. While the mold drum 101 is being rotated about the horizontal axis, the mixture for forming the resin layer is continuously casted from a casting head 105 into the molding groove 108 formed in the outer circumferential portion of the mold drum or onto the strip plate 102 for the plate spring. The strip plate 102 for the plate spring is moved along the molding groove 108 in synchronization with the circumferential speed of the groove disposed in the outer periphery of the mold drum to seal the groove, and the strip plate 102 for the plate spring having a resin layer integrally formed therewith is removed from the molding groove 108 of the mold drum downstream of the rotational direction of the mold drum. The removed strip plate 102 for the plate spring is conveyed through a guide roller 104 and a conveying roller 106, and is cut into an appropriate length by a cutter 107 disposed in a subsequent step to prepare the electrophotographic blade according to the present disclosure. In this production method, the molding groove 108 of the mold drum is covered with the strip plate 102 for the plate spring from slightly downstream of the casting position of the mixture for forming the resin layer to the take-out position to form a mold cavity 116. While the shape of the molding groove 108 is transferred to the mixture for forming the resin layer within this covered zone, the mixture is cured by heating.

Some measures to prevent leakage of the mixture for forming the resin layer from the mold cavity 116 can be taken as needed. Specifically, sealing properties can be enhanced by applying tension to the strip plate 102 for the plate spring upstream of the casting position of the mixture for forming the resin layer and downstream of the take-out position thereof or by bringing a backup belt into contact with the further outer periphery of the strip plate 102 for the plate spring.

In molding by coating forming, a thermosetting polyurethane pre-solution prepared by dispersing the thermosetting resin in a solvent is applied onto the plate spring with an applicator such as a sprayer, and is cured by heating to form a contact region in the form of a plate spring. In molding by sheet bonding, the thermoplastic resin is formed into sheets, and the sheets are bonded to each other to prepare a plate spring.

In formation of the contact region, an adhesive layer can be formed on the plate spring as needed. Examples of the material for the adhesive layer include hot-melt adhesives such as polyurethane, polyester, ethylene vinyl alcohol (EVA), and polyamide adhesives.

[Developing Unit]

FIG. 6 shows one example of the developing unit according to another aspect of the present disclosure. This developing unit 601 includes a developer container 603 which accommodates a developer 34, a developer carrying member (contact member, developing roller) 1 which conveys the developer 34, and a developer contact member 8 which regulates the thickness of the developer layer on the surface of the developer carrying member. The developer contact member 8 in use is the electrophotographic blade according to the present disclosure. The developing unit may include a developer feed roller 7 as needed.

In the developing unit 601, the developer (toner) 34 is pressed against the surface of the developer carrying member 1 rotating in the direction of the arrow b by rotating the developer feed roller 7 of the developing unit in the direction of the arrow c. The developer (toner) 34 pressed against the surface of the developer carrying member 1 enters the space between the developer contact member 2 and the developer carrying member 1 with the rotation of the developer carrying member 1 in the direction of the arrow b, and is frictionally charged by the contact region between the surface of the developer carrying member 1 and the developer contact member 2. At this time, the toner on the surface of the developer carrying member 1 corresponds to the toner layer 605 having a predetermined thickness. With the rotation of the developer carrying member 1 in the direction of the arrow b, the toner layer 605 on the surface of the developer carrying member 1 is conveyed to the nip with the photoreceptor 5 rotating in the direction of the arrow a, and an electrostatic latent image (not illustrated) on the photoreceptor 5 is developed with the toner layer 605. The residual toner which remains on the developer carrying member 1 without being consumed in the development of the electrostatic latent image is recovered to the developer container 603 from a lower portion of the developer carrying member with the rotation of the developer carrying member 1, and is scraped from the developer carrying member 1 at the nip between the developer carrying member 1 and the developer feed roller 7. At the same time, the toner inside the developer container is newly fed onto the developer carrying member 1 by the rotation of the developer feed roller 7. The newly fed toner is used in development of an electrostatic latent image on the photoreceptor in the same manner as described above. On the other hand, the toner scraped from the developer carrying member 1 is mixed with the toner inside the developer container 603 with the rotation of the developer feed roller 7.

[Process Cartridge]

Figure 7:
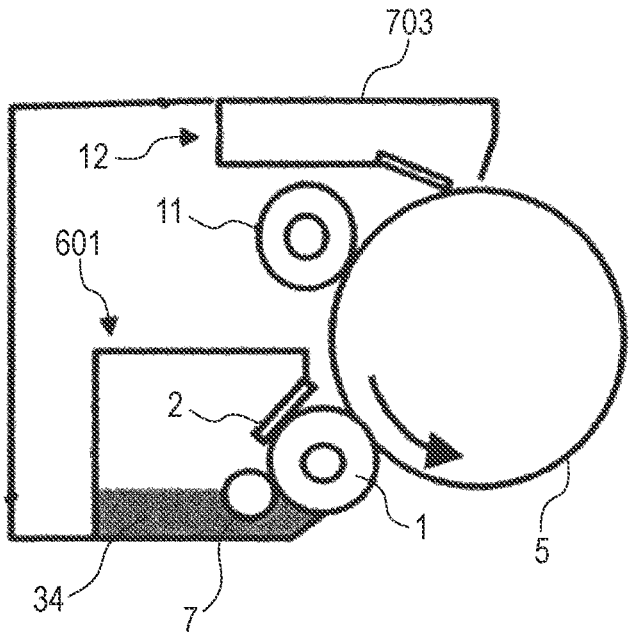
FIG. 7 is a diagram showing one example of the process cartridge according to one aspect of the present disclosure.

The process cartridge according to another aspect of the present disclosure includes a developing unit, and is detachably attachable to the body of the electrophotographic image forming apparatus. FIG. 7 shows one example of the process cartridge according to another aspect of the present disclosure. The process cartridge shown in FIG. 7 includes the developing unit 601, the photoreceptor 5, a charging roller 11, and a cleaning unit 12, which are disposed inside the frame 703 of the process cartridge. The process cartridge is detachably attachable to the body of the electrophotographic image forming apparatus. Besides the configuration above, the process cartridge according to the present disclosure can have a configuration in which a transfer member which transfers the developer image on the photoreceptor 5 onto a recording material is integrally disposed with the members above.

[Electrophotographic Image Forming Apparatus]

Figure 8:
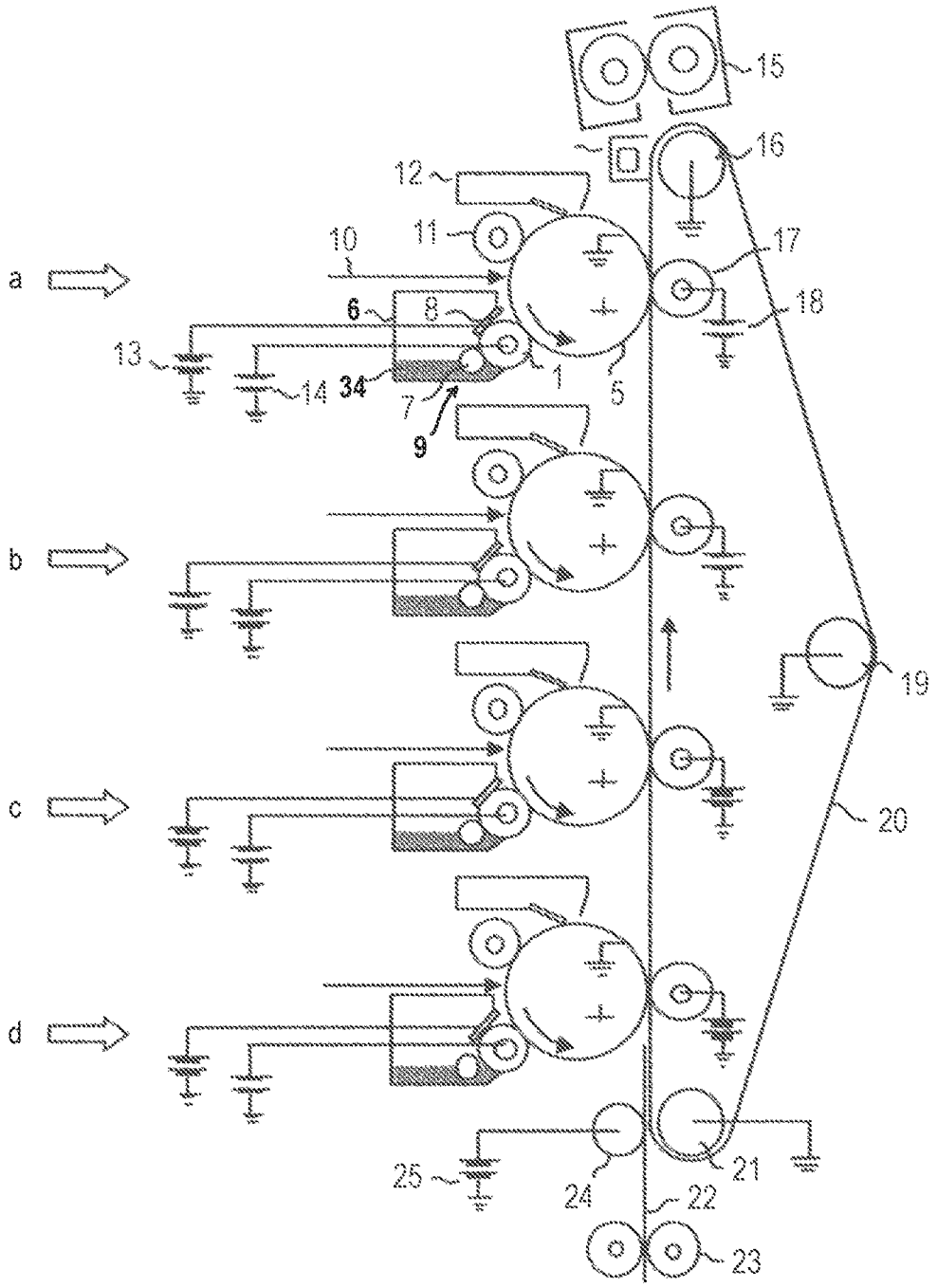
FIG. 8 is a diagram showing one example of the image forming apparatus according to one aspect of the present disclosure.

The electrophotographic image forming apparatus according to another aspect of the present disclosure includes the developing unit. FIG. 8 shows one example of the electrophotographic image forming apparatus according to the present disclosure. In FIG. 8, image forming units a to d are disposed for the color developers, i.e., a yellow toner (developer), a magenta toner (developer), a cyan toner (developer), and a black toner (developer), respectively. The image forming units a to d each include a photoreceptor 5, as an electrostatic latent image bearing member, which rotates in the arrow direction. The following components are disposed around each photoreceptor 5: a charging unit 11 for uniformly charging the photoreceptor 5, an exposing unit (not illustrated) which emits laser light 10 onto the uniformly charged photoreceptor 5 to form an electrostatic latent image, and a developing unit 9 which feeds the developer to the photoreceptor 5 having the electrostatic latent image to develop the electrostatic latent image. On the other hand, a transfer convey belt 20 which conveys the recording material 22 such as paper fed by a sheet feed roller 23 is disposed to extend around a driving roller 16, a following roller 21, and a tension roller 19. Charges of an adsorption bias power supply 25 are applied to the transfer convey belt 20 through an adsorption roller 24, and the transfer convey belt 20 conveys the recording material 22 electrostatically adsorbed to the surface of the transfer convey belt 20.

Transfer bias power supplies 18 are disposed for the image forming units a to d. Each transfer bias power supply 18 applies charges to transfer the developer image on each photoreceptor 5 onto the recording material 22 conveyed by the transfer convey belt 20. The transfer bias is applied through a transfer roller 17 disposed on the rear surface of the transfer convey belt 20. The developer images for respective colors formed by the image forming units a to d are sequentially superimposed and transferred onto the recording material 22 conveyed by the transfer convey belt 20 moved in synchronization with the image forming units a to d.

Furthermore, a color electrophotographic image forming apparatus includes a fixing unit 15 which fixes the superimposed and transferred developer images on the recording material 22 by heating, and a conveying unit (not illustrated) which discharges the recording material 22 having the resulting image to the outside of the apparatus.

Each of the image forming units includes a cleaning unit 12 including a cleaning blade which removes the transfer residual developer, which remains on the photoreceptor 5 without being transferred, to clean the surface of the photoreceptor. The cleaned photoreceptors 5 is on standby in the state where image formation is enabled.

The developing unit 9 disposed in each of the image forming units includes the developer container 6 which accommodates the developer 34, and the developer carrying member 1 which is disposed to close the opening of the developer container 6 such that a portion of the developer carrying member 1 exposed from the developer container 6 faces the photoreceptor 5.

The developer feed roller 7 is disposed inside the developer container 6 to feed the developer 34 to the developer carrying member 1 and scrape the residual developer on the developer carrying member 1, which is not used, after the development. Furthermore, the developer contact member 8 is disposed inside the developer container 6 to form the developer on the developer carrying member 1 into a thin film and frictionally charge the developer. These components are disposed in contact with the developer carrying member 1. The developer carrying member 1 and the developer feed roller 7 rotate in the forward direction.

One aspect according to the present disclosure can provide an electrophotographic blade which can maintain a stable contact state even if the contact member such as the developer carrying member vibrates, and can stably form high-quality electrophotographic images. Another aspect according to the present disclosure can provide a process cartridge and an electrophotographic image forming apparatus which can form stable electrophotographic images.

EXAMPLES

The electrophotographic blade according to the present disclosure will now be specifically described by way of Production Examples and Examples, but these should not be construed as limitation to the technical range of the present disclosure.

Example 1

1. Preparation of Thermosetting Polyurethane Composition (Synthesis of Prepolymer)

57.6 parts by mass of 4,4'-diphenylmethane diisocyanate (MDI) and 42.4 parts by mass of polytetramethylene ether glycol (PTMG) having a molecular weight of 1000 were reacted under an 80° C. nitrogen atmosphere for 3 hours to prepare a prepolymer (NCO: 15.8%).

A trade name "Millionate MT" (trade name, manufactured by Nippon Polyurethane Industry Co., Ltd.) was used as the MDI. "PTG1000" (trade name, manufactured by HODOGAYA CHEMICAL CO., LTD.) was used as the PTMG.

(Preparation of Mixture of Raw Materials for Forming Thermosetting Urethane)

The PTMG, 1,4-butanediol (manufactured by KISHIDA CHEMICAL Co., Ltd.), trimethylolpropane (manufactured by KISHIDA CHEMICAL Co., Ltd.), and a catalyst for curing urethane were mixed to prepare a mixture of raw materials for forming thermosetting urethane. The catalysts for curing used were "Polycat 46" (trade name, manufactured by Evonik Japan Co., Ltd.) as an isocyanuration catalyst and "KAOLIZER No. 25" (trade name, manufactured by Kao Corporation) as an urethanization catalyst. The composition of the materials is as shown below where the total amount of the mixture of raw materials after preparation excluding the catalysts is 100 parts by mass:

| | |
|---|---|
| PTMG | 96.0 parts by mass |
| 1,4-butanediol | 2.6 parts by mass |
| trimethylolpropane | 1.4 parts by mass |
| "Polycat46" | 130 ppm |
| "KAOLIZER No. 25" | 850 ppm |

2. Method of Producing Electrophotographic Blade

Figure 10:
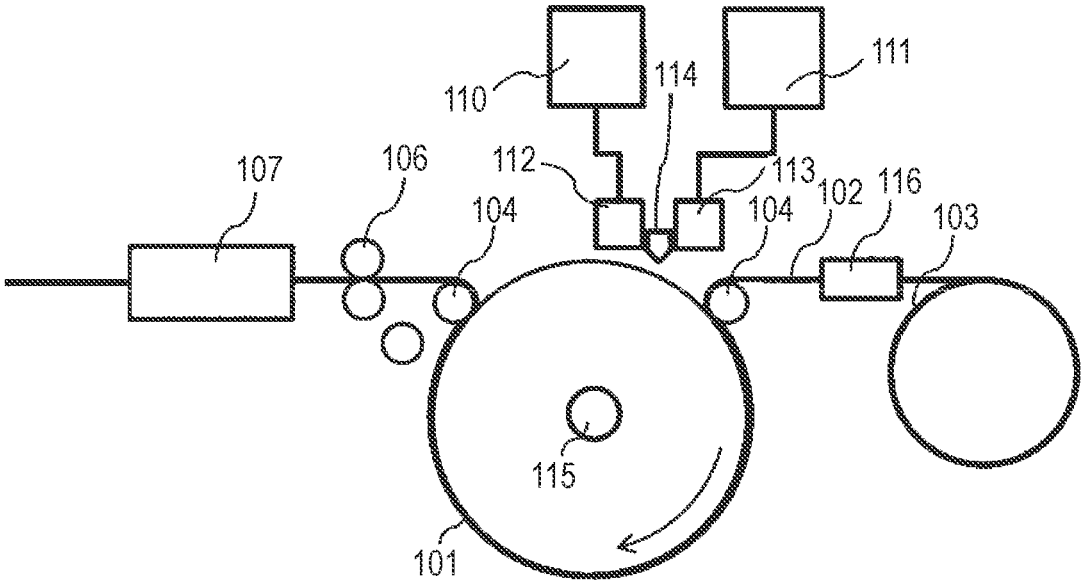
FIG. 10 is a diagram showing one example of the apparatus of producing the electrophotographic blade according to one aspect of the present disclosure.

An electrophotographic blade was produced by the production apparatus shown in FIG. 10. The prepolymer and the curing agent were placed into tanks 110 and 111, respectively, and were fed to a mixing head 114 while being measured with measure pumps 112 and 113. The prepolymer and the curing agent were uniformly mixed under stirring with the mixing head 114 to prepare a polyurethane composition.

The mold drum 101 is made of a metal, and is rotatably supported by a rotational axis 115 to be schematically horizontal. The mold drum 101 of the molding apparatus has a continuous molding groove which has a width of 6 mm and a depth of 0.1 mm and is disposed in the rotational direction, the groove being the base of the blade member for the electrophotographic apparatus. The outer circumferential portion of the mold drum is subjected to fluorine-containing plating. In Examples, the mold drum 101 was rotated at 1 rpm by a driving apparatus.

The strip plate 102 for the plate spring was made of stainless steel (SUS304) having a width of 15 mm and a thickness of 0.08 mm, and was disposed to cover the molding groove on the mold drum 101. The strip plate 102 was fed to the mold drum 101 while the travel was being adjusted by the guide 116 and the guide roller 104. The conveying roller 106 having a drive mechanism different from that of the mold drum 101 and the guide roller 104 which adjusted the travel of the strip plate 102 were rotated in synchronization with the circumferential speed of the mold drum 101.

The arrangement position of the polyurethane composition was above the mold drum at a position spaced 50 mm upstream from the initial contact portion between the mold drum 104 and the strip plate 102 for the plate spring to the moving direction of the mold drum 101. The ejection position of the polyurethane composition was a position 5 mm above from the arrangement position in the vertical direction.

The temperature of the injected polyurethane composition was adjusted to 135° C. in the molding groove of the mold drum 101 using the heating mechanism 109 disposed inside the mold drum 101 to cure the polyurethane composition by heating for a predetermined time. Subsequently, the product was removed from the mold drum 101, and was cut into a predetermined size with the cutter 107.

In the next step, the plate spring having the resin layer was welded and fixed to the support member, which was an electro-galvanized steel sheet Zincoat 21 having a chromium-free surface treated layer (trade name, manufactured by NIPPON STEEL CORPORATION). At this time, the plate spring was fixed such that the length L from the fixed end of the plate spring fixed to the support member to the other end of the plate spring was 12 mm. The force needed to displace the other end opposite to the fixed end of the plate spring fixed to the support member by 1 mm was 15 N/m.

The electrophotographic blade thus produced was evaluated for vibration absorption properties and images by the following methods.

3. Dynamic Viscoelastic Analysis

Measurement was performed suing a dynamic rheometer (trade name: EPLEXOR 500N; manufactured by GABO) under the following measurement condition. The resin layer to be measured was prepared by cutting the resin layer out of the plate spring. The results of evaluation at temperatures of 5° C., 25° C., and 40° C. are shown in Tables 5 to 7.

static load: 1.5% dynamic load: 0.25% temperature range for measurement: −30° C. to 50° C.

frequency: 10 Hz sampling: every 2° C.

heating rate: 0.5° C./min

4. Measurement of Number Average Molecular Weight of Hydrolysate of Polyurethane Composition The resin layer cut out of the plate spring was placed into a sodium hydroxide aqueous solution, followed by hydrolysis by heating at a temperature to 80° C. to prepare a hydrolysate. In the next step, the hydrolysate was neutralized with 1 N hydrochloric acid, and was dried to yield a solid of the hydrolysate. Subsequently, the solid was dissolved in THF to prepare a 0.1% by mass THF solution. The molecular weight distribution of the hydrolysate was measured using the THF solution under the following condition:

analyzer: HLC-8120GPC (manufactured by Tosoh Corporation)

columns: two columns of TSKgel SuperHZMM (manufactured by Tosoh Corporation)

solvent: THF (20 mmol/L triethylamine added)

temperature: 40° C.

flow rate of THF: 0.6 ml/min detector: RI (refractive index) detector.

The calibration curve was created using TSK standard polystyrenes A-1000, A-2500, A-5000, F-1, F-2, F-4, F-10, F-20, F-40, F-80, and F-128 (manufactured by Tosoh Corporation) as standard samples for creating the calibration curve. From the retention time of the measured sample based on the calibration curve, the proportion of polyether polyol in the hydrolysate, the number average molecular weight, and the amount (mmol/g) of an alcohol having a molecular weight of 200 or less in 1 g of the hydrolysate were determined.

Figure 9:
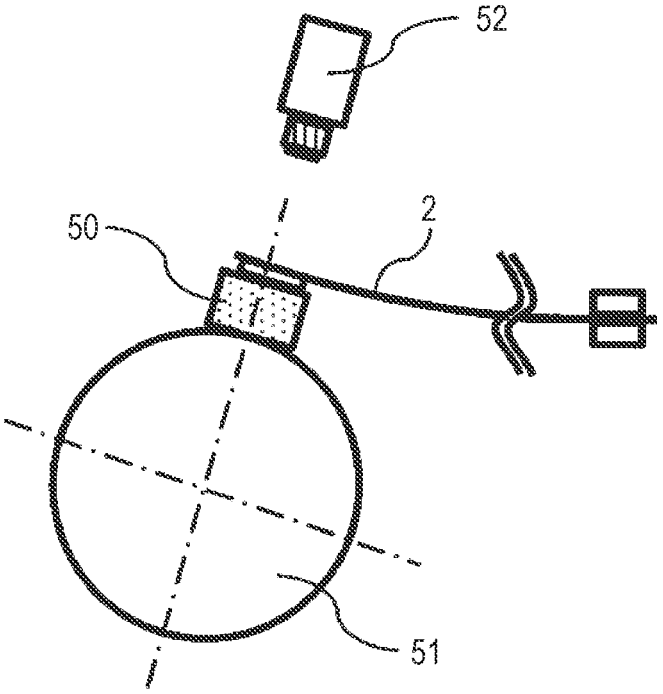
FIG. 9 is a schematic diagram of an apparatus for measuring vibration decay of the blade for forming electrophotographic images.

5. Measurement of Vibration Decay of Blade for Forming Electrophotographic Images The vibration decay of the developer regulating blade was measured using an apparatus shown in FIG. 9. Specifically, the electrophotographic blade 2 was brought into contact with a metal roller 51 through a spacer 50 at a line pressure of 40 gf/cm. The spacer 50 was present across the longitudinal region of the metal roller 51 and the electrophotographic blade 2 and had a thickness of 1 mm. The non-contact end of the electrophotographic blade 2 was fixed at a position enabling application of the contact pressure above to the metal roller 51. The displacement on the rear side of the contact region of the electrophotographic blade 2 was obtained using a microvibrometer 52 (laser Doppler vibrometer LV-1800: manufactured by Ono Sokki Co., Ltd.). In this state, the spacer 50 was pulled out of the contact region to the tangent line direction of the metal roller 51 to collide the electrophotographic blade 2 to the metal roller 51. After the collision, the electrophotographic blade 2 bounced off and collided the metal roller 51 again, and the vibration was repeated. The time taken until the amplitude reached 10 μm or less (hereinafter, also referred to as "vibration absorption time") T (millisecond (msec)) was measured. The evaluation was performed under environments at temperatures of 5° C., 25° C., and 40° C.

6. Evaluation of Image

Initially, a color laser printer (trade name: Sater-aLBP5400, manufactured by Canon Inc.) was prepared as the electrophotographic image forming apparatus. The color laser printer was modified such that the output speed of the recording medium was 200 mm/sec (size A4, vertical output). The resolution of the image was 600 dpi, and the output for primary charge was a DC voltage of −1100 V.

An electrophotographic process cartridge for the color laser printer was prepared as the electrophotographic process cartridge. The blade with regulated amount of developer attached to the electrophotographic process cartridge was replaced by the electrophotographic blade according to Examples. At this time, the displacement amount of the other end of the plate spring opposite to the fixed end 41 to the support member was adjusted to 1 mm.

The electrophotographic process cartridge was attached to the color laser printer to form electrophotographic images. The resulting image (hereinafter, also referred as "E-letter image") included a 4-point alphabetical letter "E" having a coverage rate of 1% in the area of the paper of size A4. The image forming method used was so-called intermittent printing in which the E-letter image was continuously output onto two sheets and printing was stopped for 3 seconds. After 20000 sheets of the E-letter image were output, one sheet of a halftone image (an image of horizontal lines having a width of 1 dot drawn at an interval of 2 dots in the rotational direction and the vertical direction of the electrophotographic photoreceptor) was output. The resulting halftone image was visually observed to determine the presence/absence of banding attributed to the vibration of the developing roller and uneven density and stripes attributed to poor regulation of the toner layer by the electrophotographic blade and the degree of these defects based on the following criteria. The evaluation was performed under environments at temperatures of 5° C., 25° C., and 40° C.

Criteria for Evaluation:

<Banding>

Rank A: no banding is observed.

Rank B: banding having a pitch of the developing roller is observed in part of the halftone image.

Rank C: banding is observed in the entire halftone image.

<Uneven Density, Stripes>

Rank A: no uneven density or stripes are observed.

Rank B: uneven density and/or stripes are observed.

Examples 2 to 19

Electrophotographic blades were produced in the same manner as in Example 1 except that at least one of the thickness of the plate spring, the urethane raw materials for forming the resin layer, and the thickness of the resin layer was varied as shown in Tables 1 to 3.

Comparative Examples 1 to 6

Electrophotographic blades were produced in the same manner as in Example 1 except that at least one of the thickness of the plate spring, the urethane raw materials for forming the resin layer, and the thickness of the resin layer was varied as shown in Table 4.

The results of evaluation of the electrophotographic blades according to Examples 1 to 19 and Comparative Examples 1 to 6 are shown in Tables 5 to 7. As shown in Tables 5 and 6, in the electrophotographic blades according to Examples 1 to 19, the vibration absorption time T was 3.0 msec or less at all the temperatures for measurement, and the banding, uneven density, and stripes were not observed.

In the electrophotographic blade according to Comparative Example 1, the elastic modulus at a temperature of 40° C. was 0.8 MPa. The uneven density and stripes were observed in the output image under the environment at this temperature. This is probably because the resin layer at this temperature was excessively soft and had a weak resilience, resulting in an uneven thickness of the toner layer.

In the electrophotographic blade according to Comparative Example 2, the elastic modulus at a temperature of 5° C. was 63.2 MPa. The vibration absorption time T at the same temperature was 3.1 msec, and banding was observed in the halftone image output under the environment at this temperature. This is probably because the vibration was not sufficiently relaxed at a temperature of 5° C., and thus thin portions of the toner layer were periodically generated, causing banding.

In the electrophotographic blade according to Comparative Example 3, the tan δ at a temperature of 40° C. was 0.03. The vibration absorption time T at the same temperature was 3.2 msec, and banding was observed in the halftone image output under the environment at this temperature. This is probably because the vibration was not sufficiently relaxed at a temperature of 40° C., and thus thin portions of the toner layer were periodically generated, causing banding.

In the electrophotographic blade according to Comparative Example 4, the tan δ at a temperature of 5° C. was 0.71. Uneven density and stripes were observed in the halftone image output under the environment at this temperature. This is probably because it took a long time for the resin layer to restore from deformation at this temperature, resulting in an uneven thickness of the toner layer.

In the electrophotographic blade according to Comparative Example 5, as shown in Table 7, although the vibration absorption ability was excellent, uneven density and stripes were observed in the halftone images output under the environments at all the temperatures. This is probably because the thickness of the resin layer was 2.10 mm, which varies the force applied to the toner layer on the surface of the developing roller depending on the place, resulting an uneven thickness of the toner layer.

In the electrophotographic blade according to Comparative Example 6, as shown in Table 7, the vibration absorption times T at temperatures of 25° C. and 40° C. exceeded 3.0 msec, and banding was observed in the halftone images output under the environments at these temperatures. This is probably because the thickness of the resin layer was as small as 0.04 mm and the vibration attributed to the developing roller was not sufficiently relaxed, resulting in thin portions periodically generated in the toner layer.

In Comparative Examples 1, 4, and 5, a uniformly thin layer of the developer could not be formed, causing regulation failures.

TABLE 1

| | | | Example | | | | | | | |
|---|---|---|---|---|---|---|---|---|---|---|
| | | | 1 | 2 | 3 | 4 | 5 | 6 | 7 | 8 |
| Prepolymer | NCO % | | 15.8% | 15.8% | 15.8% | 15.8% | 15.8% | 15.8% | 15.8% | 18.8% |
| | MDI compounding ratio | | 28.7 | 26.7 | 25.9 | 37.5 | 21.6 | 45 | 23.7 | 34.5 |
| | Polyol | Type | PTMG | PTMG | PTMG | PTMG | PTMG | PEG | PEG | PTMG |
| | | Molecular weight | 1000 | 1000 | 1000 | 1000 | 1500 | 400 | 1500 | 650 |
| | | Compounding ratio | 21.2 | 19.7 | 19.1 | 27.6 | 18 | 21.8 | 19.8 | 16.2 |
| Curing agent | Polyol | Type | PTMG | PTMG | PTMG | PTMG | PTMG | PEG | PEG | PTMG |
| | | Molecular weight | 1000 | 1000 | 1000 | 1000 | 1500 | 400 | 1500 | 650 |
| | | Compounding ratio | 48.1 | 51.2 | 55 | 33.5 | 59 | 31.8 | 54.3 | 48.3 |
| | Chain extender | 1,4-Butanediol | 1.3 | 1.6 | 0.0 | 0.9 | 1.0 | 0.9 | 1.5 | 0.6 |
| | | TMP | 0.7 | 0.85 | 0 | 0.49 | 0.52 | 0.46 | 0.79 | 0.34 |
| | Catalyst | "Polycat46" (ppm) | 130 | 130 | 130 | 130 | 130 | 130 | 130 | 130 |
| | | "KAOLIZER No. 25" (ppm) | 850 | 850 | 850 | 850 | 850 | 850 | 850 | 850 |
| Plate spring | Material | | SUS | SUS | SUS | SUS | SUS | SUS | SUS | SUS |
| | Thickness (mm) | | 0.08 | 0.08 | 0.08 | 0.08 | 0.08 | 0.08 | 0.08 | 0.08 |
| | Force needed to displace the other end opposite to fixed end by 1 mm (N/m) | | 15 | 15 | 15 | 15 | 15 | 15 | 15 | 15 |
| Resin layer | Width (mm) | | 6.0 | 6.0 | 6.0 | 6.0 | 6.0 | 6.0 | 6.0 | 6.0 |
| | Thickness (mm) | | 0.10 | 0.10 | 0.10 | 0.10 | 2.00 | 0.05 | 1.00 | 0.10 |

TABLE 2

| | | | Example | | | | | | |
|---|---|---|---|---|---|---|---|---|---|
| | | | 9 | 10 | 11 | 12 | 13 | 14 | 15 |
| Prepolymer | NCO % | | 17.0% | 15.8% | 15.8% | 17.3% | 8.8% | 15.8% | 15.8% |
| | MDI compounding ratio | | 28.3 | 21.6 | 51.2 | 28.6 | 28.7 | 28.7 | 28.7 |
| | Polyol | Type | PTMG | PTMG | PEG | PTMG | Polybutylene adipate polyol | polycaprolactone-based polyol | Polycarbonate polyol |

TABLE 2-continued

| | | | Example | | | | | | |
|---|---|---|---|---|---|---|---|---|---|
| | | | 9 | 10 | 11 | 12 | 13 | 14 | 15 |
| | | Molecular weight | 1500 | 1500 | 300 | 2000 | 2000 | 1000 | 1000 |
| | | Compounding ratio | 20.9 | 18.0 | 20.9 | 21.7 | 54.8 | 21.2 | 21.2 |
| Curing agent | Polyol | Type | PTMG | PTMG | PEG | PTMG | Polybutylene adipate polyol | polycaprolactone-based polyol | Polycarbonate polyol |
| | | Molecular weight | 1500 | 1500 | 300 | 2000 | 1000 | 1000 | 1000 |
| | | Compounding ratio | 46.9 | 59.0 | 26.8 | 44.7 | 12.6 | 48.1 | 48.1 |
| | Chain extender | 1,4-Butanediol | 2.5 | 1.0 | 0.7 | 3.2 | 2.2 | 1.3 | 1.3 |
| | | TMP | 1.37 | 0.52 | 0.39 | 1.74 | 1.79 | 0.7 | 0.7 |
| | Catalyst | "Polycat46" (ppm) | 130 | 130 | 130 | 130 | 130 | 130 | 130 |
| | | "KAOLIZER No. 25" (ppm) | 850 | 850 | 850 | 850 | 850 | 850 | 850 |
| Plate spring | Material | | SUS | SUS | SUS | SUS | SUS | SUS | SUS |
| | Thickness (mm) | | 0.08 | 0.08 | 0.08 | 0.08 | 0.08 | 0.08 | 0.08 |
| | Force needed to displace the other end opposite to fixed end by 1 mm (N/m) | | 15 | 15 | 15 | 15 | 15 | 15 | 15 |
| Resin layer | Width (mm) | | 6.0 | 6.0 | 6.0 | 6.0 | 6.0 | 6.0 | 6.0 |
| | Thickness (mm) | | 0.10 | 0.10 | 0.10 | 0.10 | 0.10 | 0.10 | 0.10 |

TABLE 3

| | | | Example | | | |
|---|---|---|---|---|---|---|
| | | | 16 | 17 | 18 | 19 |
| Prepolymer | NCO % | | 15.80% | 15.80% | 15.80% | 15.80% |
| | MDI compounding ratio | | 28.7 | 28.7 | 28.7 | 28.7 |
| | Polyol | Type | PTMG | PTMG | PTMG | PTMG |
| | | Molecular weight | 1000 | 1000 | 1000 | 1000 |
| | | Compounding ratio | 21.2 | 21.2 | 21.2 | 21.2 |
| Curing agent | Polyol | Type | PTMG | PTMG | PTMG | PTMG |
| | | Molecular weight | 1000 | 1000 | 1000 | 1000 |
| | | Compounding ratio | 48.1 | 48.1 | 48.1 | 48.1 |
| | Chain extender | 1,4-Butanediol | 1.3 | 1.3 | 1.3 | 1.3 |
| | | TMP | 0.7 | 0.7 | 0.7 | 0.7 |
| | Catalyst | "Polycat46" (ppm) | 130 | 130 | 130 | 130 |
| | | "KAOLIZER No. 25" (ppm) | 850 | 850 | 850 | 850 |
| Plate spring | Material | | SUS | SUS | SUS | SUS |
| | Thickness (mm) | | 0.08 | 0.08 | 0.15 | 0.06 |
| | Force needed to displace the other end opposite to fixed end by 1 mm (N/m) | | 15 | 15 | 99 | 8 |
| Resin layer | Width (mm) | | 6.0 | 6.0 | 6.0 | 6.0 |
| | Thickness (mm) | | 2.0 | 0.05 | 1.0 | 1.0 |

TABLE 4

| | | | Comparative Example | | | | | |
|---|---|---|---|---|---|---|---|---|
| | | | 1 | 2 | 3 | 4 | 5 | 6 |
| Prepolymer | NCO % | | 15.8% | 8.8% | 15.8% | 15.8% | 15.8% | 15.8% |
| | MDI compounding ratio | | 22.0 | 31.0 | 19.9 | 26.9 | 28.7 | 28.7 |
| | Polyol | Type | PEG | Polybutylene adipate polyol | PTMG | Polycarbonate polyol | PTMG | PTMG |
| | | Molecular weight | 1500 | 2000 | 1500 | 1000 | 1000 | 1000 |
| | | Compounding ratio | 18.4 | 59.3 | 16.6 | 19.8 | 21.2 | 21.2 |
| Curing agent | Polyol | Type | PEG | Polybutylene adipate polyol | PTMG | Polycarbonate polyol | PTMG | PTMG |
| | | Molecular weight | 1500 | 1000 | 1500 | 1000 | 1000 | 1000 |
| | | Compounding ratio | 57.2 | 7.3 | 61.9 | 51.1 | 48.1 | 48.1 |

TABLE 4-continued

| | | | Comparative Example | | | | | |
|---|---|---|---|---|---|---|---|---|
| | | | 1 | 2 | 3 | 4 | 5 | 6 |
| | Chain extender | 1,4-Butanediol | 1.5 | 1.3 | 1.0 | 1.4 | 1.3 | 1.3 |
| | | TMP | 1.04 | 1.04 | 0.54 | 0.75 | 0.7 | 0.7 |
| | Catalyst | "POLYCAT46" (ppm) | 130 | 130 | 130 | 130 | 130 | 130 |
| | | "KAOLIZER No. 25" (ppm) | 850 | 850 | 850 | 850 | 850 | 850 |
| Plate spring | Material | | SUS | SUS | SUS | SUS | SUS | SUS |
| | Thickness (mm) | | 0.08 | 0.08 | 0.08 | 0.08 | 0.08 | 0.08 |
| | Force needed to displace the other end opposite to fixed end by 1 mm (N/m) | | 15 | 15 | 15 | 15 | 15 | 15 |
| Resin layer | Width (mm) | | 6 | 6 | 6 | 6 | 6 | 6 |
| | Thickness (mm) | | 0.10 | 0.10 | 0.10 | 0.10 | 2.10 | 0.04 |

TABLE 5

| | | | Example | | | | | | | |
|---|---|---|---|---|---|---|---|---|---|---|
| | | | 1 | 2 | 3 | 4 | 5 | 6 | 7 | 8 |
| tanδ | | 5° C. | 0.28 | 0.18 | 0.22 | 0.35 | 0.21 | 0.35 | 0.15 | 0.30 |
| | | 25° C. | 0.10 | 0.08 | 0.08 | 0.12 | 0.07 | 0.18 | 0.07 | 0.12 |
| | | 40° C. | 0.05 | 0.05 | 0.05 | 0.08 | 0.05 | 0.10 | 0.05 | 0.07 |
| Elastic modulus (MPa) | | 5° C. | 7.4 | 6.5 | 7.1 | 9.8 | 5.2 | 10.2 | 4.2 | 9.2 |
| | | 25° C. | 5.8 | 4.3 | 5.5 | 6.1 | 3.0 | 7.4 | 2.5 | 5.8 |
| | | 40° C. | 5.8 | 4.3 | 5.5 | 6.1 | 2.5 | 5.2 | 1.8 | 3.2 |
| Proportion of polyether polyol (wt %) | | | 69 | 71 | 74 | 61 | 77 | 54 | 74 | 64 |
| Average molecular weight of polyether polyol | | | 980 | 980 | 980 | 980 | 1490 | 400 | 1490 | 650 |
| Content of alcohol having molecular weight of 200 or less (mmol/g) | | | 0.20 | 0.24 | 0.00 | 0.14 | 0.14 | 0.13 | 0.22 | 0.09 |
| Vibration absorption time T (msec) | | 5° C. | 0.8 | 1.0 | 0.7 | 0.8 | 1.0 | 1.3 | 1.0 | 1.0 |
| | | 25° C. | 1.5 | 1.6 | 1.3 | 1.0 | 1.2 | 1.5 | 1.2 | 1.3 |
| | | 40° C. | 2.0 | 2.0 | 1.8 | 1.4 | 1.7 | 1.7 | 1.5 | 1.6 |
| Rank in image evaluation | Banding | 5° C. | A | A | A | A | A | A | A | A |
| | | 25° C. | A | A | A | A | A | A | A | A |
| | | 40° C. | A | A | A | A | A | A | A | A |
| | Uneven density/ stripes | 5° C. | A | A | A | A | A | A | A | A |
| | | 25° C. | A | A | A | A | A | A | A | A |
| | | 40° C. | A | A | A | A | A | A | A | A |

TABLE 6

| | | Example | | | | | | | | | | |
|---|---|---|---|---|---|---|---|---|---|---|---|---|
| | | 9 | 10 | 11 | 12 | 13 | 14 | 15 | 16 | 17 | 18 | 19 |
| tanδ | 5° C. | 0.30 | 0.18 | 0.35 | 0.25 | 0.62 | 0.32 | 0.68 | 0.28 | 0.28 | 0.28 | 0.28 |
| | 25° C. | 0.08 | 0.08 | 0.18 | 0.08 | 0.29 | 0.12 | 0.32 | 0.10 | 0.10 | 0.10 | 0.10 |
| | 40° C. | 0.05 | 0.06 | 0.10 | 0.05 | 0.21 | 0.07 | 0.17 | 0.05 | 0.05 | 0.05 | 0.05 |
| Elastic modulus (MPa) | 5° C. | 7.6 | 5.3 | 10.2 | 7.6 | 55.9 | 32.2 | 49.9 | 7.4 | 7.4 | 7.4 | 7.4 |
| | 25° C. | 6.0 | 3.1 | 7.4 | 5.5 | 17.4 | 12.0 | 22.3 | 5.8 | 5.8 | 5.8 | 5.8 |
| | 40° C. | 5.8 | 2.9 | 5.2 | 5.3 | 14.1 | 6.0 | 10.3 | 5.8 | 5.8 | 5.8 | 5.8 |
| Proportion of polyether polyol (wt %) | | 68 | 77 | 48 | 66 | — | — | — | 69 | 69 | 69 | 69 |
| Average molecular weight of polyether polyol | | 1490 | 1490 | 300 | 1970 | — | — | — | 980 | 980 | 980 | 980 |
| Content of alcohol having molecular weight of 200 or less (mmol/g) | | 0.38 | 0.14 | 0.11 | 0.49 | — | — | — | 0.20 | 0.20 | 0.20 | 0.20 |
| Vibration absorption time T (msec) | 5° C. | 1.2 | 1.0 | 1.3 | 1.0 | 2.5 | 1.6 | 2.3 | 0.8 | 1.5 | 0.8 | 0.8 |
| | 25° C. | 1.4 | 1.5 | 1.5 | 1.2 | 2.3 | 2.0 | 1.8 | 1.1 | 2.1 | 1.1 | 1.1 |
| | 40° C. | 2.0 | 2.2 | 1.7 | 1.5 | 2.8 | 2.5 | 2.3 | 2.0 | 2.8 | 2.0 | 2.0 |

TABLE 6-continued

| | | | Example | | | | | | | | | | |
|---|---|---|---|---|---|---|---|---|---|---|---|---|---|
| | | | 9 | 10 | 11 | 12 | 13 | 14 | 15 | 16 | 17 | 18 | 19 |
| Rank in image evaluation | Banding | 5° C. | A | A | A | A | A | A | A | A | A | A | A |
| | | 25° C. | A | A | A | A | A | A | A | A | A | A | A |
| | | 40° C. | A | A | A | A | A | A | A | A | A | A | A |
| | Uneven density/ stripes | 5° C. | A | A | A | A | A | A | A | A | A | A | A |
| | | 25° C. | A | A | A | A | A | A | A | A | A | A | A |
| | | 40° C. | A | A | A | A | A | A | A | A | A | A | A |

TABLE 7

| | | | Comparative Example | | | | | |
|---|---|---|---|---|---|---|---|---|
| | | | 1 | 2 | 3 | 4 | 5 | 6 |
| tanδ | | 5° C. | 0.15 | 0.58 | 0.18 | 0.71 | 0.28 | 0.28 |
| | | 25° C. | 0.08 | 0.25 | 0.05 | 0.35 | 0.10 | 0.10 |
| | | 40° C. | 0.05 | 0.22 | 0.03 | 0.12 | 0.05 | 0.05 |
| Elastic modulus (MPa) | | 5° C. | 3.8 | 63.2 | 4.8 | 45.3 | 7.4 | 7.4 |
| | | 25° C. | 2.1 | 25.4 | 2.5 | 23.2 | 5.8 | 5.8 |
| | | 40° C. | 0.8 | 17.5 | 1.8 | 9.5 | 5.8 | 5.8 |
| Proportion of polyether polyol (wt %) | | | 76 | — | 79 | — | 69 | 69 |
| Average molecular weight of polyether polyol | | | 1490 | — | 1490 | — | 980 | 980 |
| Content of alcohol having molecular weight of 200 or less (mmol/g) | | | 0.23 | — | 0.15 | — | 0.20 | 0.20 |
| Vibration absorption time T (msec) | | 5° C. | 1.3 | 3.1 | 1.5 | 1.8 | 0.8 | 2.5 |
| | | 25° C. | 1.6 | 2.5 | 2.8 | 1.1 | 1.1 | 3.1 |
| | | 40° C. | 2.0 | 2.0 | 3.2 | 2.0 | 2.0 | 3.5 |
| Rank in image evaluation | Banding | 5° C. | A | B | A | A | A | A |
| | | 25° C. | A | A | A | A | A | B |
| | | 40° C. | A | A | C | A | A | C |
| | Uneven density/ stripes | 5° C. | A | A | A | B | B | A |
| | | 25° C. | A | A | A | A | B | A |
| | | 40° C. | B | A | A | A | B | A |

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-069810, filed Apr. 8, 2020, and Japanese Patent Application No. 2021-027566, filed Feb. 24, 2021, which are hereby incorporated by reference herein in their entirety.

What is claimed is:

1. An electrophotographic blade comprising:

a plate spring, and a resin layer that covers at least a part of a surface of the plate spring to form a contact region wherein one end portion of the plate spring is fixed so that a length (L) from a fixed end to another end of the plate spring is 5 mm or more and 20 mm or less, such that a force needed to displace the another end by 1 mm is 5 N/m or more and 100 N/m or less, and wherein the resin layer satisfies the following requirements (1) to (3):

(1) the thickness of the resin layer is 0.05 mm or more and 2.00 mm or less, (2) the tan δ value of the resin layer in the range of 5° C. or more and 40° C. or less is 0.05 or more and 0.70 or less, and (3) the elastic modulus of the resin layer is 1.0 MPa or more and 60.0 MPa or less.

2. The electrophotographic blade according to claim 1, wherein the resin layer is a thermally cured urethane elastomer.

3. The electrophotographic blade according to claim 2, wherein the thermally cured urethane elastomer has a structure represented by the following formula (1) between two adjacent urethane bonds:

$$—[(CH_2)_nO]_m— \quad \text{Formula (1)}$$

where n represents an integer of 2 or more, m represents an integer of 1 or more, and n and m are numeric values needed to control an average molecular weight of the portion having the alkylene oxide structure represented by the formula (1) to be at least 380 or more and 1600 or less.

4. The electrophotographic blade according to claim 2, wherein a hydrolysate of the thermally cured urethane elastomer contains a component represented by the following formula (2), and the proportion of the component in the hydrolysate is 50 wt % or more and 80 wt % or less:

$$HO—[(CH_2)_nO]_m—H \quad \text{Formula (2)}$$

where n represents an integer of 2 or more, m represents an integer of 1 or more, and n and m are numeric values needed to control an average molecular weight of the portion having the alkylene oxide structure in formula (2) to be at least 380 or more and 1600 or less.

5. The electrophotographic blade according to claim 4, wherein the hydrolysate is free from an alcohol having a molecular weight of 200 or less.

6. The electrophotographic blade according to claim 4, wherein the hydrolysate contains 0.25 mmol/g or less of the alcohol having a molecular weight of 200 or less.

7. An electrophotographic image forming apparatus comprising an electrophotographic blade, and a developer carrying member that is in contact with the electrophotographic blade, wherein the electrophotographic blade comprises:

a plate spring; and a resin layer that covers at least a part of a surface of the plate spring to form a contact region that comes into contact with the developer carrying member, wherein one end portion of the plate spring is fixed so that a length (L) from a fixed end to another end of the plate spring is 5 mm or more and 20 mm or less, such that a force needed to displace the another end by 1 mm is 5 N/m or more and 100 N/m or less, and wherein the resin layer satisfies the following requirements (1) to (3):

(1) the thickness of the resin layer is 0.05 mm or more and 2.00 mm or less, (2) the tan δ value of the resin layer in the range of 5° C. or more and 40° C. or less is 0.05 or more and 0.70 or less, and (3) the elastic modulus of the resin layer is 1.0 MPa or more and 60.0 MPa or less.

8. A process cartridge detachably attachable to a body of an electrophotographic image forming apparatus, the process cartridge comprising:

an electrophotographic blade, and a developer carrying member that is in contact with the electrophotographic blade, wherein the electrophotographic blade comprises:

a plate spring;

a resin layer that covers at least part of a surface of the plate spring to form a contact region that comes into contact with the developer carrying member, wherein one end portion of the plate spring is fixed so that a length (L) from a fixed end to another end is 5 mm or more and 20 mm or less, such that a force needed to displace the another end by 1 mm is 5 N/m or more and 100 N/m or less, and wherein the resin layer satisfies the following requirements (1) to (3):

(1) the thickness of the resin layer is 0.05 mm or more and 2.00 mm or less, (2) the tan δ value of the resin layer in the range of 5° C. or more and 40° C. or less is 0.05 or more and 0.70 or less, and (3) the elastic modulus of the resin layer is 1.0 MPa or more and 60.0 MPa or less.

* * * * *